US007454998B1

(12) United States Patent
Hsieh

(10) Patent No.: US 7,454,998 B1
(45) Date of Patent: Nov. 25, 2008

(54) SOCKET ASSEMBLY

(76) Inventor: Chih-Ching Hsieh, 5F-2, No. 181, Sec. 2, Mei-Tsun Rd., Taichung City (TW)

( * ) Notice: Subject to any disclaimer, the term of this patent is extended or adjusted under 35 U.S.C. 154(b) by 0 days.

(21) Appl. No.: 11/492,026

(22) Filed: Jul. 25, 2006

(51) Int. Cl.
*B25B 13/58* (2006.01)

(52) U.S. Cl. ..... 81/185; 81/180.1; 81/119; 81/120; 81/121.1; 81/124.2

(58) Field of Classification Search ..... 81/180.1, 81/185, 119, 120, 121.1, 124.2
See application file for complete search history.

(56) References Cited

U.S. PATENT DOCUMENTS 4,328,720 A * 5/1982 Shiel ..... 81/63
4,840,094 A * 6/1989 Macor ..... 81/185
6,389,931 B1 * 5/2002 Delaney et al. ..... 81/60
6,467,379 B1 * 10/2002 Wizman ..... 81/185
6,637,298 B1 * 10/2003 O'Brien et al. ..... 81/124.5

* cited by examiner

*Primary Examiner*—Joseph J. Hail, III
*Assistant Examiner*—Shantese McDonald

(57) ABSTRACT

A socket assembly includes an outer part and an inner part which is inserted in the outer part. A flange extends radially outward from an end of the inner part and is mounted on an end of the outer part. The outer part is made by steel and the inner part is made by aluminum. A positioning device is located between the outer part and the inner part. The positioning device includes a plurality of grooves defined in an inner periphery of the outer part and a plurality of ribs extend from an outer periphery of the inner part. The ribs are engaged with the grooves.

3 Claims, 8 Drawing Sheets

SOCKET ASSEMBLY

FIELD OF THE INVENTION

The present invention relates to a socket assembly including an inner part and an outer part, the inner part includes a protection flange mounted on an end of the outer part so as to protect object form being scrubbing.

BACKGROUND OF THE INVENTION

A conventional socket generally includes a tubular body with a first recess in one end and a second recess in a second end of the tubular body. The first recess receives a driving protrusion of a hand tool such as a wrench and the second recess receives an object to be loosened or tightened. The socket is generally made by steel and has a high degree of stiffness so that when the socket contacts an object, the socket might scrub the object. U.S. Pat. No. 6,397,706 discloses a protective socket which includes an inner part made by softer material and an outer part which is made by hard material. The inner part is inserted in the outer part and one end of the inner part extends out from an end of the outer part such that when using the socket, the end of the inner part extending beyond the socket can be a protect device to contact the object without damaging the object.

However, it is noted that the inner pat has a smooth outer periphery and the outer part has a smooth inner periphery so that the inner part cannot be well positioned in the outer part. In addition, the inner part might be twisted during using the socket and disengaged from the outer part.

The present invention intends to provide a socket assembly wherein the inner part has ribs or grooves in an outer periphery thereof and the outer part has groove or ribs which are engaged with the grooves or ribs. By this way, the inner part is not disengaged from the outer part.

SUMMARY OF THE INVENTION

The present invention relates to a socket assembly which comprises an outer part made by steel and an inner part which is inserted in the outer part and made by aluminum. A flange extends radially outward from an end of the inner part and is mounted on an end of the outer part. The outer part is made by steel and the inner part is made by aluminum. A positioning device is located between the outer part and the inner part. The positioning device includes a plurality of grooves defined in an inner periphery of the outer part and a plurality of ribs extend from an outer periphery of the inner part. The ribs are engaged with the grooves.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
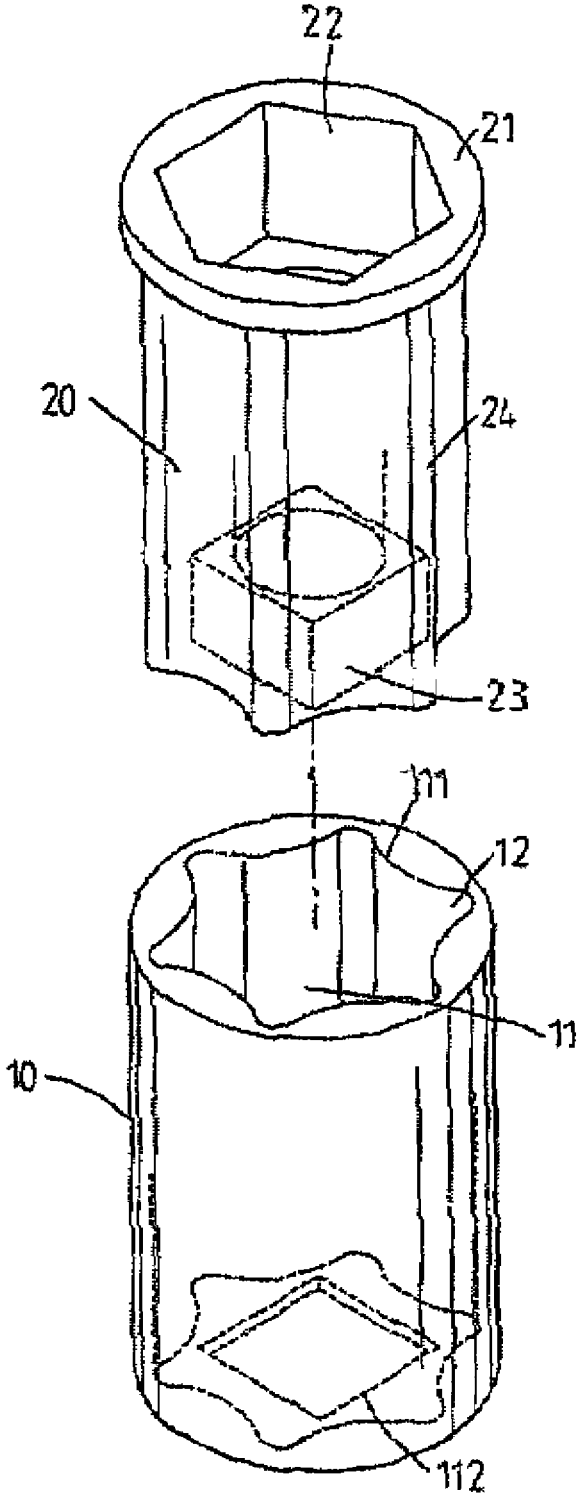
FIG. 1 is an exploded view to show a first embodiment of the socket assembly of the present invention.
Figure 2:
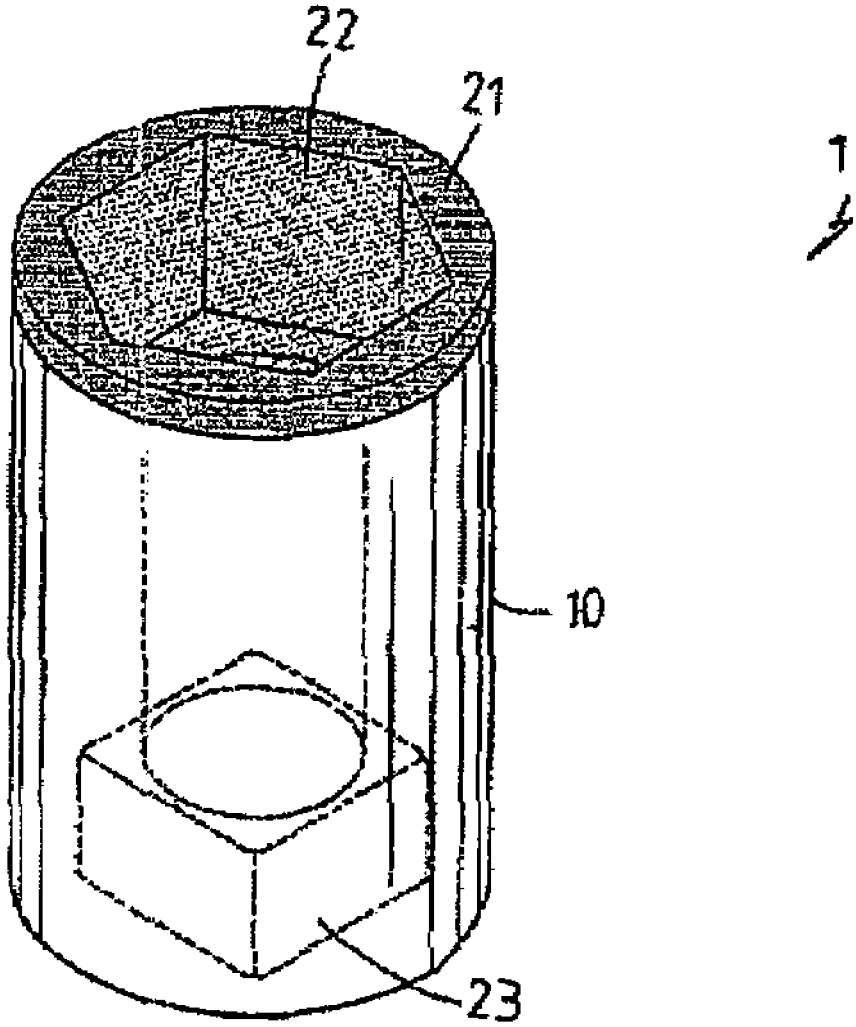
FIG. 2 is a perspective view to show the socket assembly of the present invention.
Figure 3:
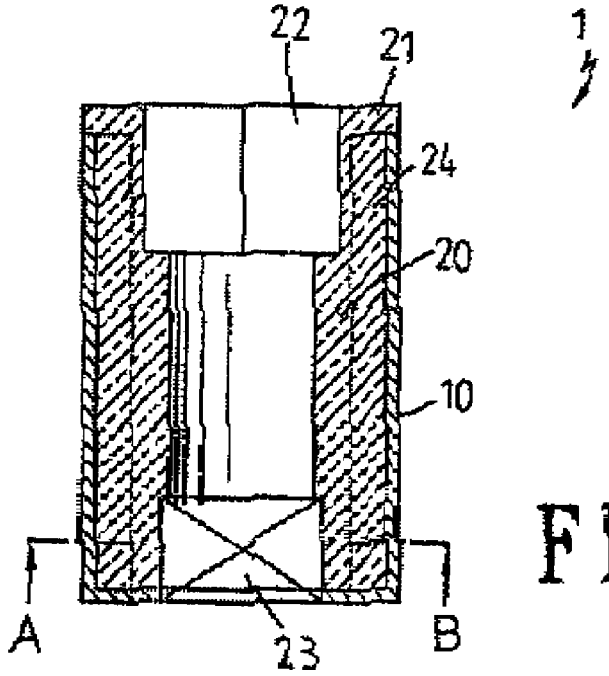
FIG. 3 is a side cross sectional view of the socket assembly of the present invention.
Figure 4:
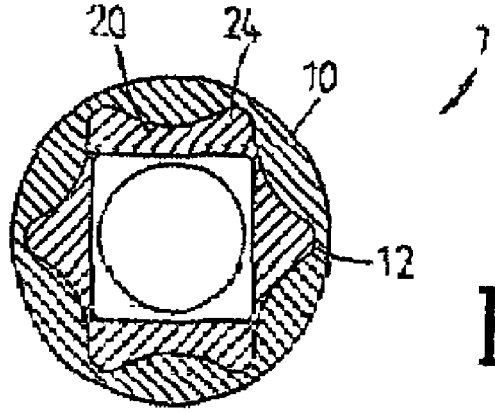
FIG. 4 is an end cross sectional view along line A-B in FIG. 3 of the socket assembly of the present invention.
Figure 5:
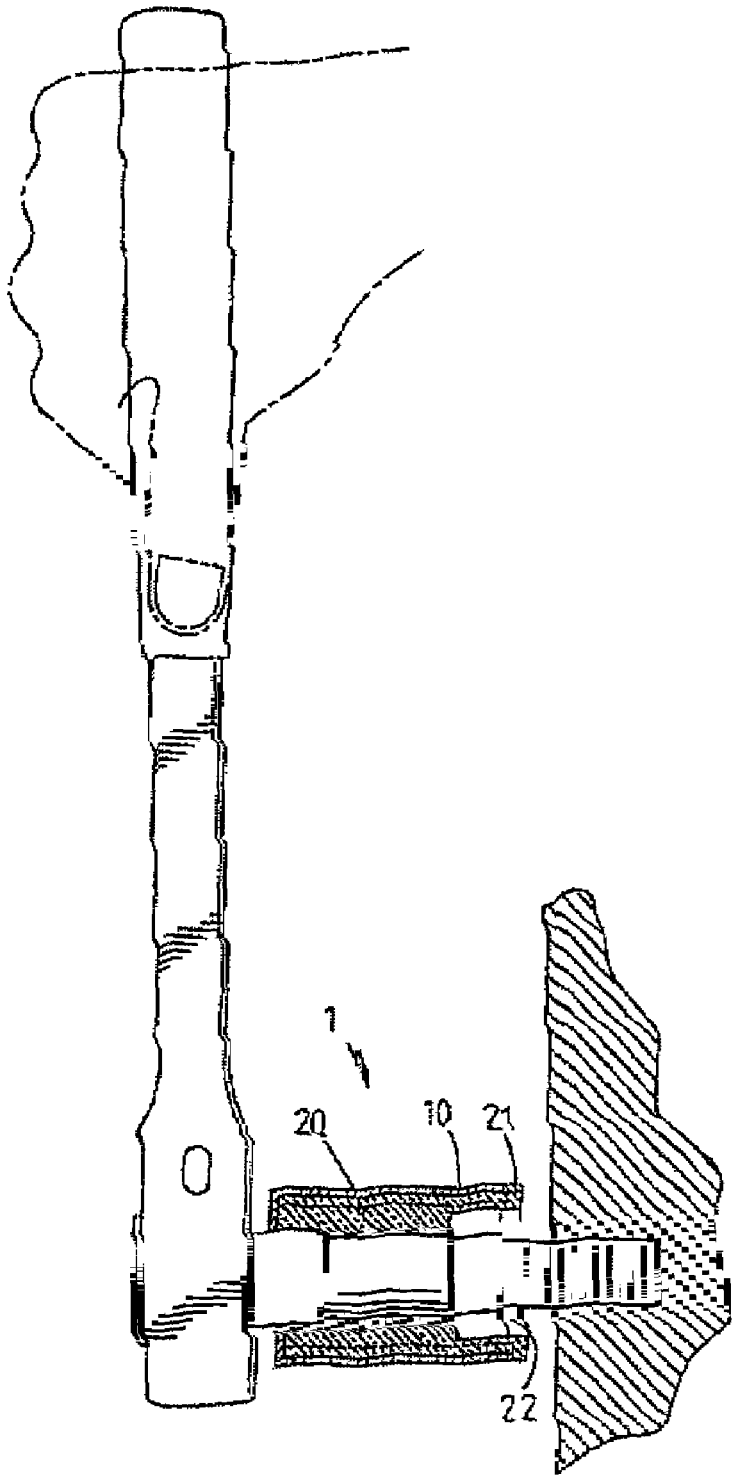
FIG. 5 shows that the socket is connected with a hand tool to rotate a bolt.

Referring to FIGS. 1 to 5, the socket assembly 1 of the present invention comprises an outer part 10 which is a tubular member with a reception space 11 defined in an end thereof and an opening 111 is defined in a first end of the outer part 10. A square or rectangular recess 112 is defined in a second end of the outer part 10 so as to be cooperated with a driving member of a hand tool as shown in FIG. 5. An inner part 20 is a tubular member and has a first end inserted in the reception space 11 of the outer part 10. A through hole 23 is defined in the first end of the inner part 20. A polygonal recess 22 is defined in a second end of the inner part 20 so as to receive a bolt head therein. A flange 21 extends radially outward from the second end of the inner part 20. The flange 21 mounted on the first end of the outer part 10.

A positioning device is located between the outer part 10 and the inner part 20 so as to position the inner part 20 to the outer part 10. The positioning device includes a plurality of grooves 12 defined in an inner periphery of the outer part 10 and a plurality of ribs 24 extend from an outer periphery of the inner part 20. The ribs 24 are engaged with the grooves 12.

Figure 7:
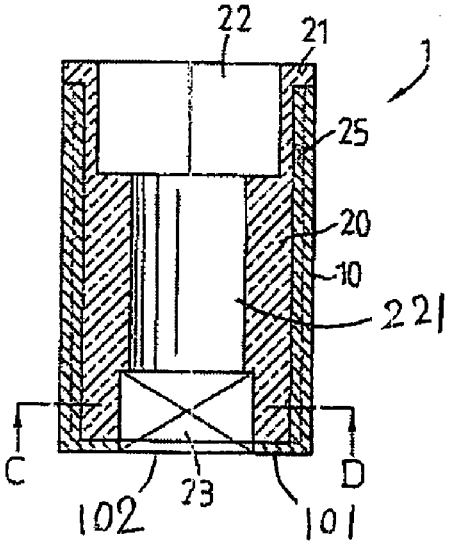
FIG. 7 is a side cross sectional view of the socket assembly in FIG. 6 of the present invention.
Figure 8:
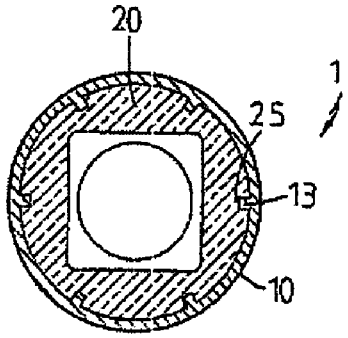
FIG. 8 is an end cross sectional view along line C-D in FIG. 7 of the socket assembly of the present invention.
Figure 6:
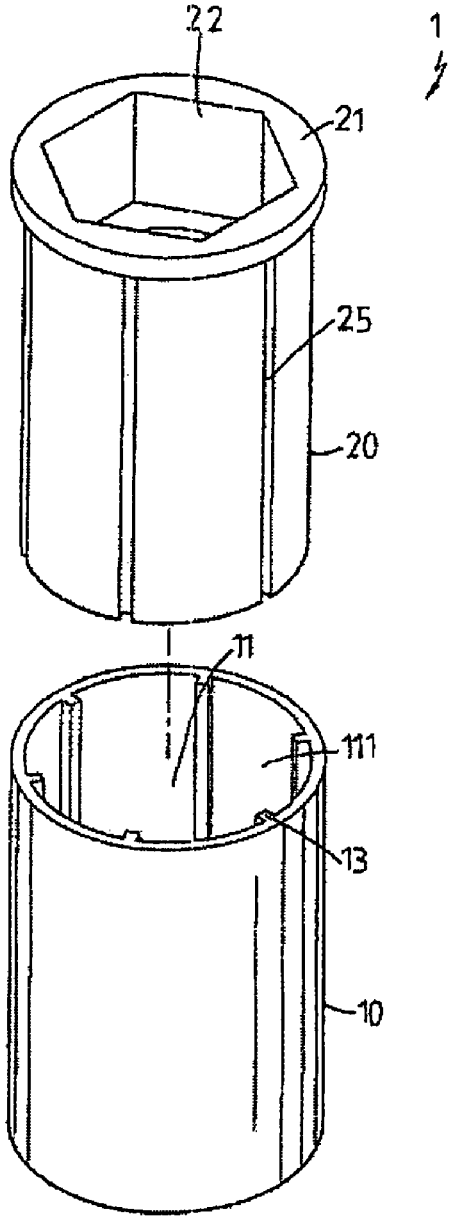
FIG. 6 is an exploded view to show a second embodiment of the socket assembly of the present invention.

Referring to FIGS. 6 to 8, the second embodiment of the socket assembly 1 is disclosed, wherein the positioning device includes a plurality of rectangular ribs 13 extending from an inner periphery of the outer part 10 and a plurality of grooves 25 are defined in an outer periphery of the inner part 20. The ribs 13 are engaged with the grooves 25.

Figure 10:
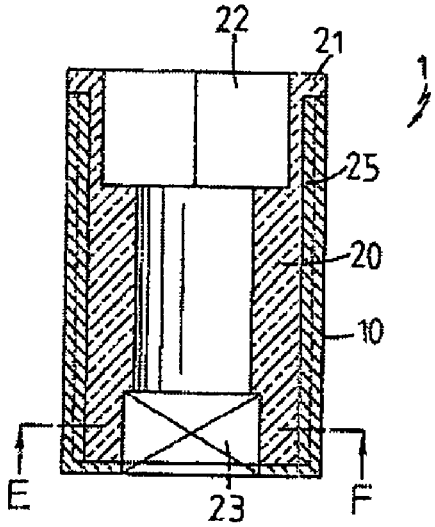
FIG. 10 is a side cross sectional view of the socket assembly in FIG. 9 of the present invention.
Figure 11:
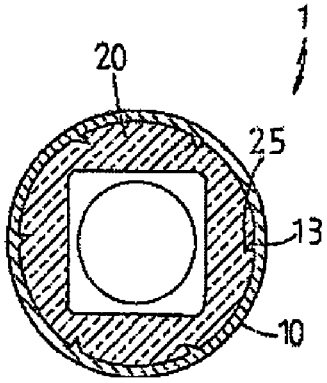
FIG. 11 is an end cross sectional view along line E-F in FIG. 10 of the socket assembly of the present invention.
Figure 9:
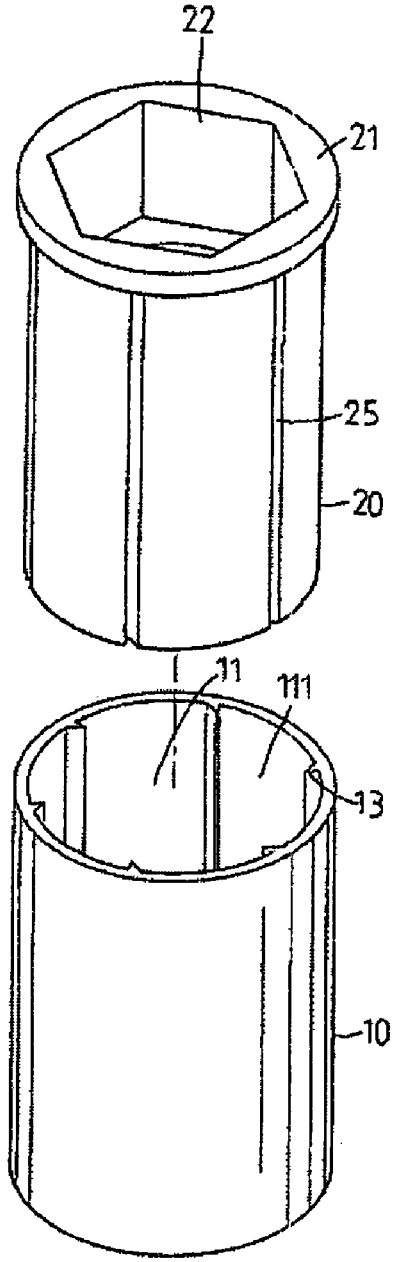
FIG. 9 is an exploded view to show a third embodiment of the socket assembly of the present invention.

The positioning device includes a plurality of ribs 13 extending from an inner periphery of the outer part 10. A plurality of rectangular grooves 25 are defined in an outer periphery of the inner part 20, and the rectangular ribs 13 are engaged with the rectangular groove 25. A flange extends radially outwards from an end of the inner part 20, and the flange 21 is mounted on an end of the outer part 10. In the inner part 10 has a recess and the recess has a hexagonal upper side 22, an approximate round middle section 221 and an approximate rectangular lower section 23. The outer part 20 is a cylindrical shape and a bottom 101 of the outer part 20 has a rectangular hole 102;

FIGS. 9 to 11 show the third embodiment of the socket assembly 1, wherein the positioning device includes a plurality of rectangular ribs 13 extending from an inner periphery of the outer part 10 and a plurality of grooves 25 are defined in an outer periphery of the inner part 20. The ribs 13 are engaged with the grooves 25.

It is noted that the ribs 24, 13 each can be a curved, rectangular or triangular cross section, and each groove 12, 25 is shaped to be complementary to the ribs 24, 13.

Figure 14:
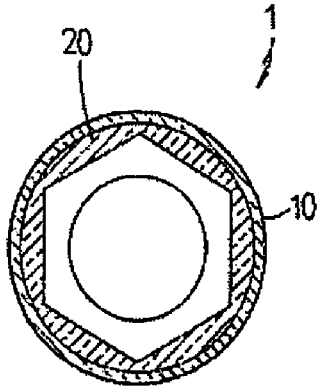
FIG. 14 is an end cross sectional view along line G-H in FIG. 13 of the socket assembly of the present invention.
Figure 13:
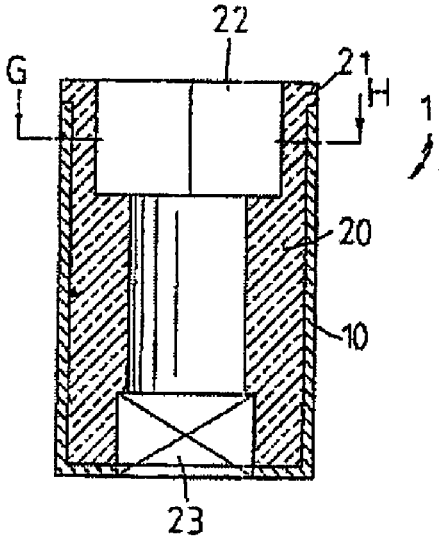
FIG. 13 is a side cross sectional view of the socket assembly in FIG. 12 of the present invention.
Figure 12:
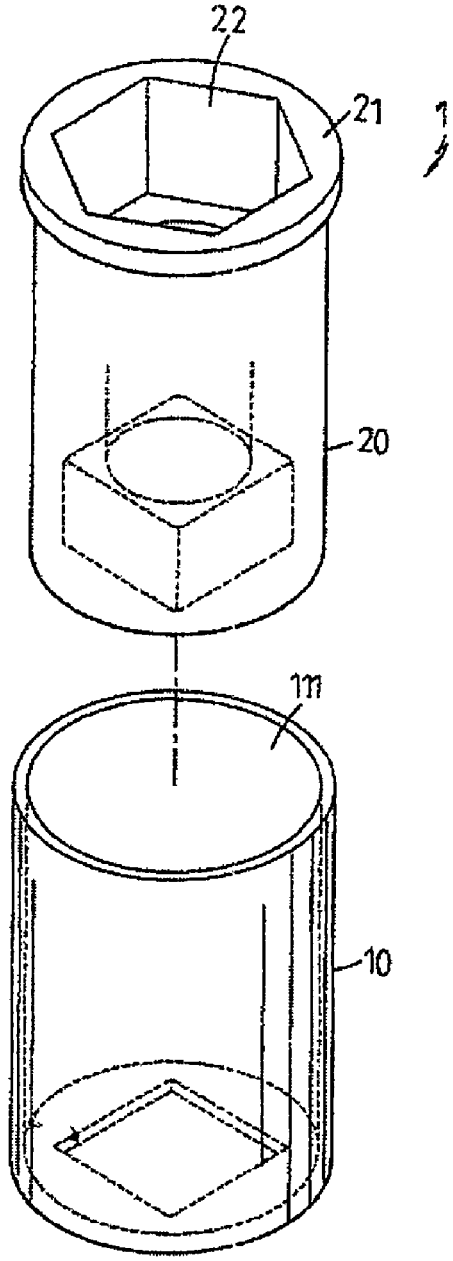
FIG. 12 is an exploded view to show a fourth embodiment of the socket assembly of the present invention.

FIGS. 12 to 14 show a fourth embodiment of the socket assembly 1 wherein the inner periphery of the outer part 10 can be a circular periphery without any rib or groove, and the outer periphery of the inner part 20 is also a circular surface without any groove or rib.

Figure 15:
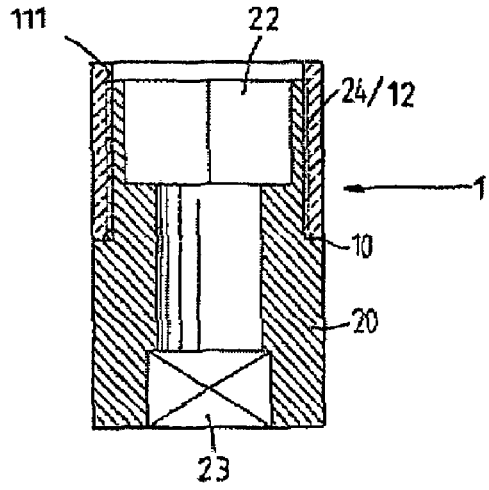
FIG. 15 is a side cross sectional view to show a fifth embodiment of the socket assembly of the present invention.

FIG. 15 shows a fifth embodiment of the socket assembly 1 wherein the outer part 10 is shorter than the inner part 20, and an end 111 of the outer part 10 is mounted to a narrow section of the inner part 20. An end of the outer part 10 projects from the end with the polygonal recess 22 of the inner part 20. The positioning device located between the outer part 10 and the inner part 20 includes a plurality of grooves 12 defined in an inner periphery of the outer part 10 and a plurality of ribs 24 extend from an outer periphery of the inner part 20. The ribs 24 are engaged with the grooves 12. Of course, the positioning device can be that a plurality of ribs extend from an inner periphery of the outer part 10, and a plurality of grooves are defined in an outer periphery of the inner part 20. The ribs are engaged with the grooves. The ribs 24 each have a curved, rectangular or triangular cross section, and each groove 12 is shaped to be complementary to the ribs 24. In this embodiment, the outer part 10 is made by aluminum and the inner part 20 is made by steel. Therefore, the end of the outer part 10 that projects out from the end of the inner part 20 contacts with the object and because the outer part 10 is made by softer material so that the object will not be damaged or scrubbed by the outer part 10.

Figure 16:
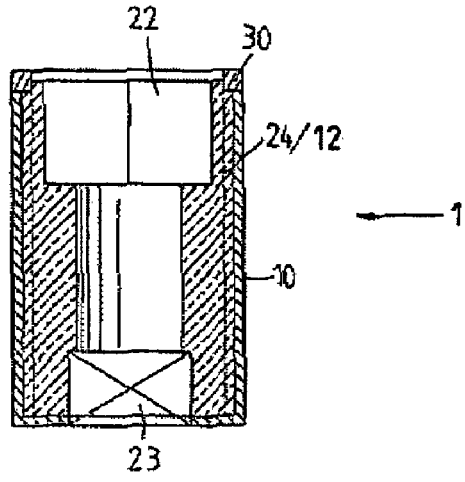
FIG. 16 is a side cross sectional view to show a sixth embodiment of the socket assembly of the present invention.

FIG. 16 shows a sixth embodiment of the socket assembly 1, wherein the inner part 20 is inserted in the outer part 10, and a ring 30 is connected to an end of the outer part 10 and protrudes beyond of the end of the inner part 20 that has the polygonal recess 22. The positioning device located between the outer part 10 and the inner part 20 includes a plurality of grooves 12 defined in an inner periphery of the outer part 10 and a plurality of ribs 24 extend from an outer periphery of the inner part 20, the ribs 24 are engaged with the grooves 12. Again, the positioning device can be that a plurality of ribs extending from an inner periphery of the outer part 10, and a plurality of grooves are defined in an outer periphery of the inner part. The ribs are engaged with the grooves. The ribs 24 each have a curved, rectangular or triangular cross section, and each groove 12 is shaped to be complementary to the ribs 24. The outer part 10 is made by steel and the inner part 20 is made by aluminum. The ring 30 is also made by softer material.

While we have shown and described the embodiment in accordance with the present invention, it should be clear to those skilled in the art that further embodiments may be made without departing from the scope of the present invention.

What is claimed is:

1. A socket assembly, comprising:

an outer part and an inner part which is inserted in the outer part, and a positioning device located between the outer part and the inner part;

wherein the positioning device includes a plurality of rectangular ribs extending from an inner periphery of the outer part, a plurality of rectangular grooves are defined in an outer periphery of the inner part, and the rectangular ribs are engaged with the rectangular groove; and wherein a flange extending raidally outwards from an end of the inner part, the flange mounted on an end of the outer part; and wherein the inner part has a recess; the recess has a hexagonal upper section, an approximate round middle section and an approximate rectangular lower section; and wherein the outer part is a cylindrical shape and a bottom of the outer part has a rectangular hole.

2. The assembly as claimed in claim 1, wherein the outer part is made by steel.

3. The assembly as claimed in claim 1, wherein the inner part is made by aluminum.

* * * * *